US008174513B2

(12) United States Patent
Sono et al.

(10) Patent No.: US 8,174,513 B2
(45) Date of Patent: May 8, 2012

(54) APPARATUS AND METHOD FOR GENERATING PROGRAMMABLE SIGNAL FOR DRIVING DISPLAY PANEL

(75) Inventors: Koichi Sono, Suwon-si (KR); Young-sun Kim, Suwon-si (KR); Tae-young Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 2607 days.

(21) Appl. No.: 10/745,465

(22) Filed: Dec. 24, 2003

(65) Prior Publication Data

US 2005/0001826 A1 Jan. 6, 2005

(30) Foreign Application Priority Data

Dec. 26, 2002 (KR) ..... 10-2002-0084082

(51) Int. Cl.
*G09G 5/00* (2006.01)

(52) U.S. Cl. ..... 345/204; 345/60

(58) Field of Classification Search ..... 345/68, 345/204, 60, 97; 315/169.4; 711/170
See application file for complete search history.

(56) References Cited

U.S. PATENT DOCUMENTS 6,441,860 B1 * 8/2002 Yamaguchi et al. ..... 348/555
6,636,187 B2 * 10/2003 Tajima et al. ..... 345/55
6,700,571 B2 * 3/2004 Nakatani et al. ..... 345/213
7,109,073 B2 * 9/2006 Yamazaki ..... 438/150

FOREIGN PATENT DOCUMENTS

JP 5-341727 A 12/1993
JP 2000-298449 * 10/2000

* cited by examiner

*Primary Examiner* — Abbas Abdulselam
(74) *Attorney, Agent, or Firm* — Sughrue Mion, PLLC

(57) ABSTRACT

An apparatus and method for driving a display panel, and more particularly, an apparatus and method for easily generating a programmable signal to drive a digital display panel without re-designing a drive signal generating apparatus according to the specifications of the digital display panel including its size, the number of scan lines, and types of input signals. The apparatus includes a memory, a decoder, and an output waveform generating circuit. The memory stores information to generate a plurality of drive pulse signals necessary for driving the display panel. The decoder reads information stored in an address assigned according to a predetermined control sequence from the memory and then edits the read information so as to be suitable for specifications of the display panel. The output waveform generating circuit generates drive pulse signals corresponding to the information read by the decoder.

17 Claims, 12 Drawing Sheets

FIG. 9

| Sub Field | SF1 | SF2 | SF3 | SF4 | SF5 | SF6 | SF7 | SF8 | SF9 | SF10 | SF11 | SF12 | SF13 | SF14 | SF15 | SF16 |
|---|---|---|---|---|---|---|---|---|---|---|---|---|---|---|---|---|
| Group No. | 0 | 1 | 1 | 1 | 2 | 2 | 2 | 2 | 3 | 3 | 3 | 4 | 4 | 4 | 4 | 5 |

FIG. 10

| Sub Field | SF1 | SF2 | SF3 | SF4 | SF5 | SF6 | SF7 | SF8 | SF9 | SF10 | SF11 | SF12 | SF13 | SF14 | SF15 | SF16 |
|---|---|---|---|---|---|---|---|---|---|---|---|---|---|---|---|---|
| Masking | ON | ON | ON | ON | OFF | OFF | OFF | OFF | OFF | OFF | OFF | OFF | ON | ON | ON | ON |

FIG. 11

| Name | Sequence | XY Table No. | Repeat SW | Repeat Select | Eosf |
|---|---|---|---|---|---|
| Value | 1 | 5 | 0 | 0 | 0 |
| | 2 | 6 | 1 | 1 | 0 |
| | 3 | 7 | 0 | 1 | 0 |
| | 4 | 8 | 2 | 2 | 0 |
| | 5 | 9 | 3 | 3 | 0 |
| | ... | | | | |
| | 32 | 15 | 0 | 0 | 1 |
| | 1105 | 1101 | 1102 | 1103 | 1104 |

FIG. 12

| Name / bit | Period | Delay Select | Duration Time | XY Pulse | | | | | | | |
|---|---|---|---|---|---|---|---|---|---|---|---|
| | | | | 1 | 2 | 3 | 4 | ... | 46 | 47 | 48 |
| Value | 1 | 0 | 10 | 0 | 1 | 1 | 0 | ... | 1 | 1 | 0 |
| | 2 | 1 | 20 | 1 | 1 | 0 | 0 | ... | 0 | 1 | 0 |
| | 3 | 3 | 30 | 1 | 0 | 1 | 0 | ... | 1 | 1 | 0 |
| | 4 | 0 | 40 | 1 | 0 | 0 | 1 | ... | 1 | 1 | 1 |
| | 1201 | 1202 | 1203 | | | | | 1204 | | | |

FIG. 13

| Delay No. | Delay Value |
|---|---|
| 0 | 0 |
| 1 | 5 |
| 2 | 15 |
| 3 | 10 |
| ... | |
| 16 | 0 |

FIG. 14

| Name | Period | Delay Select | Duration Time | XY Pulse | | | | | | | |
|---|---|---|---|---|---|---|---|---|---|---|---|
| bit | | | | 1 | 2 | 3 | 4 | ... | 46 | 47 | 48 |
| Value | 1 | 0 | 10 | 0 | 1 | 1 | 0 | ... | 1 | 1 | 0 |
| | 2 | 5 | 20 | 1 | 1 | 0 | 0 | ... | 0 | 1 | 0 |
| | 3 | 10 | 30 | 1 | 0 | 1 | 0 | ... | 1 | 1 | 0 |
| | 4 | 0 | 40 | 1 | 0 | 0 | 1 | ... | 1 | 1 | 1 |

| Repeat No. | Repeat Value |
|---|---|
| 1 | 3 |
| 2 | 10 |
| 3 | 5 |
| ... | |
| 8 | 0 |

| XY No. | 1 | 2 | 3 | 4 | ··· | 48 |
|---|---|---|---|---|---|---|
| Masking SW | ON | OFF | ON | OFF | ··· | OFF |

| Address | Data |
|---|---|
| 0000 ~1FFF | NTSC Data |
| 2000 ~2FFF | PAL Data |
| 3000 ~3FFF | HD Data |

2101
2102
2103

APPARATUS AND METHOD FOR GENERATING PROGRAMMABLE SIGNAL FOR DRIVING DISPLAY PANEL

BACKGROUND OF THE INVENTION

This application claims the priority of Korean Patent Application No. 2002-84082, filed on Dec. 26, 2002, in the Korean Intellectual Property Office, the disclosure of which is incorporated herein in its entirety by reference.

1. Field of the Invention

The present invention relates to an apparatus and method for driving a display panel. More particularly, the present invention relates to an apparatus and method for easily generating a programmable signal to drive a digital display panel without re-designing a drive signal generating apparatus according to the specifications of the digital display panel including its size, the number of scan lines, and types of input signals.

2. Description of the Related Art

Digital display devices are classified into plasma display panels (PDPs), ferroelectric liquid crystal panels (FLCs), and the like.

In general, the PDPs are next generation flat display devices which display characters or images using plasma generated by discharging gas. Several hundreds of thousands to several millions of pixels are arranged in the PDPs in the matrix form according to their sizes.

FIG. 1 shows a PDP driving circuit to which the present invention is applied.

A drive sequence of a PDP is divided into a reset period, an address period, and a sustain period. In the reset period, display hysteresis is erased by discharging all cells and eliminating wall charges from the cells. In the address period, a discharge cell is selected by making a matrix configuration from combinations of column and row electrodes of the PDP to form an address discharge. In the sustain period, the discharge cell formed in the address period is iteratively charged and/or discharged using an energy recovery process to display an image.

The PDP driving circuit determines timings to switch various switches on and off based on an Address Display Separation (ADS) method in order to display an image. As shown in FIG. 1, Ys, Yg, Xs, and Xg denote sustain switches to apply a high-frequency alternating current (AC) pulsed-voltage to the PDP for a sustain period of the PDP. A pair of switches Ys and Xg and a pair of switches Xs and Yg are alternately switched on and/or off for the sustain period. Yr, Yf, Xr, and Xf denote switches of an energy recovery circuit which reduces power consumption by preventing fluctuations in a panel voltage and a capacitive displacement current for the sustain period. LY and LX denote inductors to recover energy. C_Yerc and C_Xerc denote capacitors, D_Yr, D_Xf, D_Xr, D_Xf, D_YvsC, and D_YGC denote diodes. The capacitors C_Yerc and C_Xerc and the diodes D_Yr, D_Xr, D_Xf, D-YvsC, and D_YGC are components necessary for the energy recovery circuit suggested by Weber et al. (U.S. Pat. No. 4,866,349). In general, sustain switches, energy recovery switches, and passive devices are incorporated into a circuit network which is called a "sustain circuit". According to the ADS method, the sustain circuit operates for the sustain period of the PDP. Yp denotes a switch which is used to separate the address and reset circuits from the sustain circuit. Yrr, Yfr, and Xrr denote switches which are used to apply lamp type high voltages to the PDP for the reset period. That is, the switches Yrr, Yfr, and Xrr operate together with capacitors Cset and C_Xsink to apply higher voltages than a power voltage to the PDP for the reset period. Ysc and Ysp are switches which operate for the address period according to the ADS method. In particular, the switch Ysp is turned on and the switch Ysc is turned off for the address period, whereas the switch Ysp is turned off and the switch Ysc is turned on for the reset and sustain periods. A scan driver integrated circuit (IC) 100 includes a shift register and a voltage buffer, applies a horizontal synchronous signal to a screen of the PDP for the address period, and short-circuits for the reset and sustain periods. The detailed operation of an existing PDP driving circuit in compliance with a switching sequence is disclosed in U.S. Pat. No. 4,866,349.

Such a PDP driving circuit must apply X and Y drive signals suitable for types of input signals and the size of the PDP to each of the switches of FIG. 1 according to a drive sequence in order to generate X and Y electrode voltages as shown in FIG. 4 in each period.

As shown in FIG. 4, a PDP XY controller generally includes a counter 404 and a timing generating logic circuit 406. A horizontal synchronous signal H_Sync 401, a vertical synchronous signal V_sync 402, and a data enable signal Data_Enable 403 are applied to the counter 404. The time generating logic circuit 406 includes individual logic circuits and generates the X and Y drive signals so as to be suitable for the specifications of a PDP product such as its size, the number of scan lines, the number of pixels, and types of input video signals such as an NTSC video signal, a PAL video signal, etc.

Accordingly, as shown in FIG. 5, the PDP XY controller must be differently designed according to the size of the PDP. Also, as shown in FIG. 6, the PDP XY controller generates the X and Y drive signals so as to be suitable for the PDP driving circuit by selecting an NTSC XY controller 602-1 or a PAL XY controller 602-2 based on the type of an input video signal determined by a signal detector 601.

In summary, according to the related art, an XY controller must be differently designed according to the size of a PDP, the type of an input video signal, and so forth. Thus, components of the PDP are required to be re-designed whenever the specifications of the PDP are changed. As a result, developing PDPs becomes costly and time-consuming.

In addition, when a single PDP displays a plurality of types of video signals, X and Y drive signals should be changed according to the types of the video signals. Thus, the single PDP requires a plurality of XY controllers that can be appropriately switched. As a result, the volume of the single PDP increases.

SUMMARY OF THE INVENTION

The present invention provides an apparatus and method for generating a programmable signal to drive a digital display panel by which data on the specifications of a PDP that are required to generate a PDP drive signal is stored in a memory and then appropriately edited so as to be suitable for the PDP used in order to generate XY drive signals.

According to an aspect of the present invention, there is provided an apparatus for generating a programmable signal to drive a display panel. The apparatus includes a memory, a decoder, and an output waveform generating circuit. The memory stores information to generate a plurality of drive pulse signals necessary for driving the display panel. The decoder reads information stored in an address assigned according to a predetermined control sequence from the memory and then edits the read information so as to be suitable for specifications of the display panel. The output waveform generating circuit generates drive pulse signals corresponding to the information read by the decoder.

According to another aspect of the present invention, there is provided a method for generating a programmable drive signal to drive a display panel. Information to generate a plurality of drive pulse signals necessary for driving the display panel is stored. Information stored in an address assigned according to a predetermined control sequence is read from the memory, and then the read information is edited so as to be suitable for specifications of the display panel. Drive pulse signals corresponding to the information read by the decoder are generated.

BRIEF DESCRIPTION OF THE DRAWINGS

The above and other features and advantages of the present invention will become more apparent by describing in detail exemplary embodiments thereof with reference to the attached drawings in which:

FIG. 9 is a view showing the detailed configuration of a sub field chain of FIG. 8;

FIG. 10 is a view showing the detailed configuration of a masking sub field table of FIG. 8;

FIG. 11 is a view showing the detailed configuration of a sequence schedule of FIG. 8;

FIG. 12 is a view showing the detailed configuration of an XY table of FIG. 8;

FIG. 13 is a view showing the detailed configuration of a delay table of FIG. 8;

FIG. 14 is a view showing an example of an XY table to which information of a delay table is applied;

DETAILED DESCRIPTION OF THE INVENTION

Figure 1:
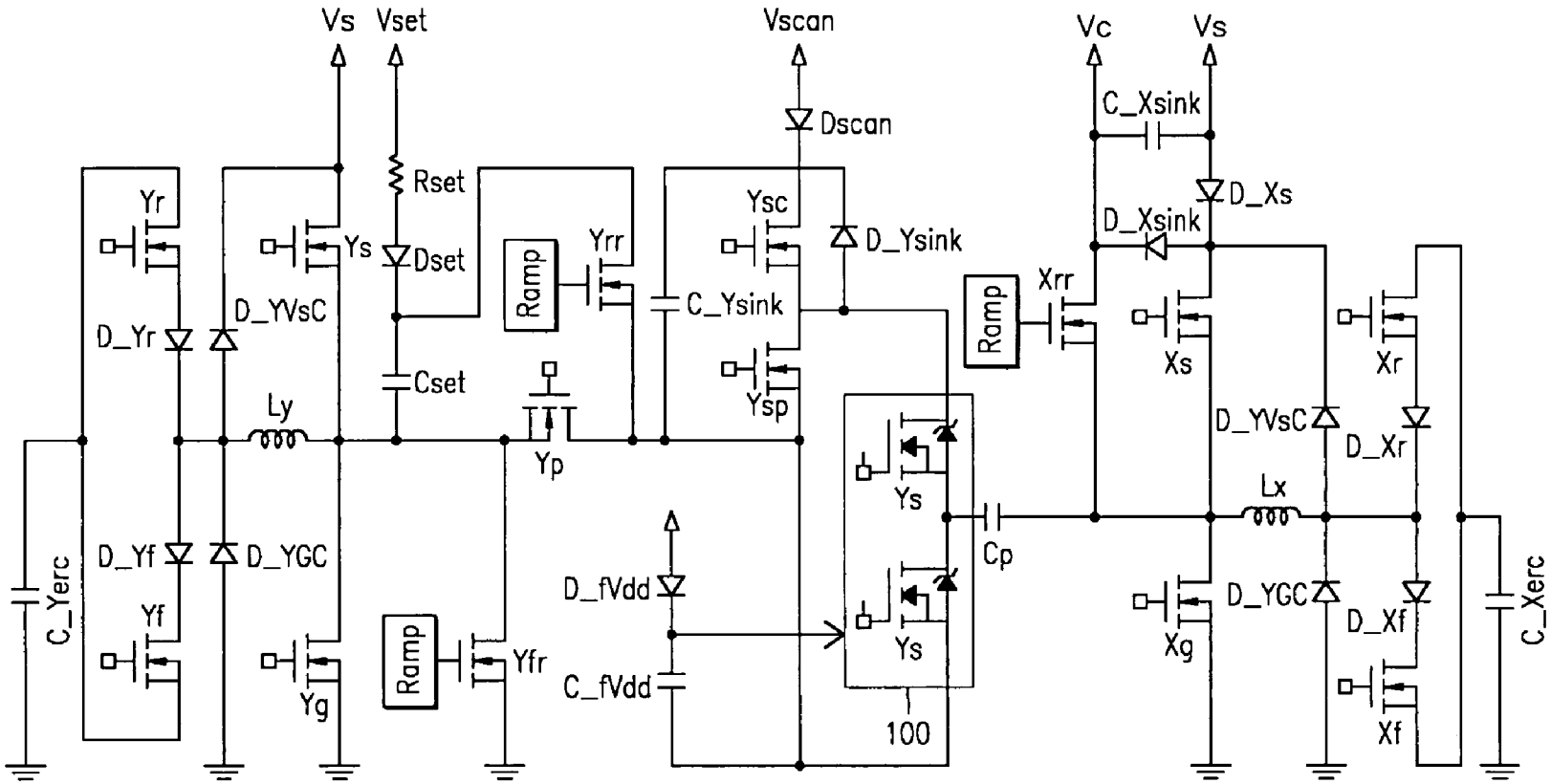
FIG. 1 is a view showing the configuration of a PDP driving circuit to which the present invention is applied.
Figure 2:
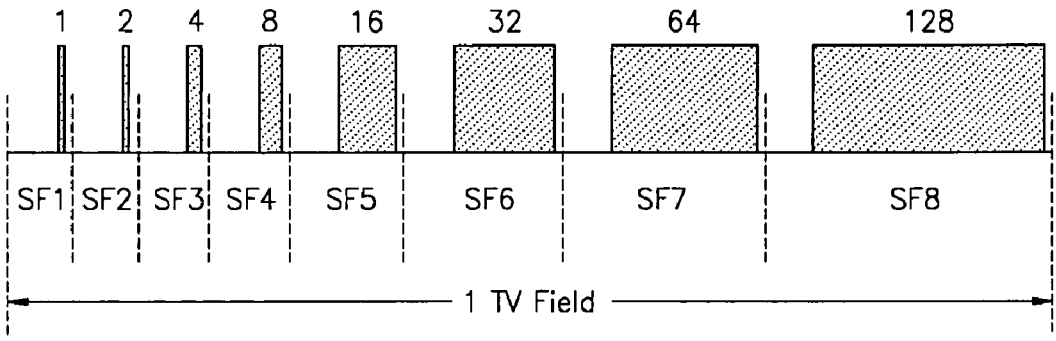
FIG. 2 is a view for explaining a sub field-based time division gradation display method applied in the driving of a PDP.

In general, a PDP displays images in a time-division gradation display way to divide a 1TV field into a plurality of sub fields. That is, as an example, as shown in FIG. 2, a 1TV field includes 8 sub fields with different weights, i.e., different discharge numbers. Thus, the maximum discharge number of the 1TV field is 255. The sub fields are turned on or off every pixel to represent a 256 gradation image including 0-255 levels.

Figure 3:
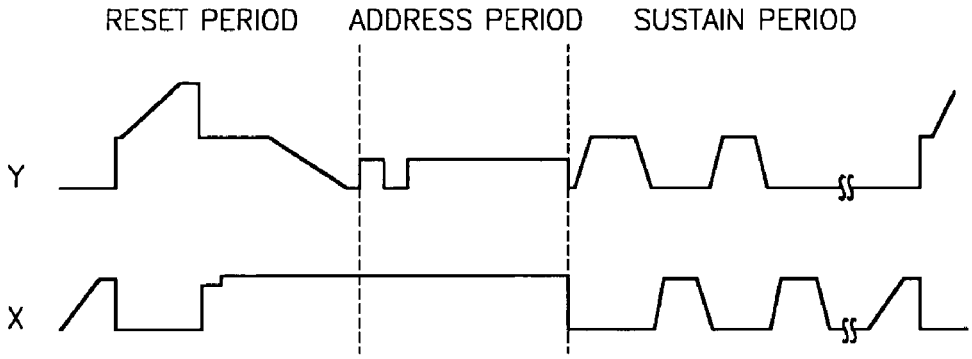
FIG. 3 is a view showing voltages of X and Y electrodes in reset, address, and sustain periods of the PDP driving circuit of FIG. 1.
Figure 4:
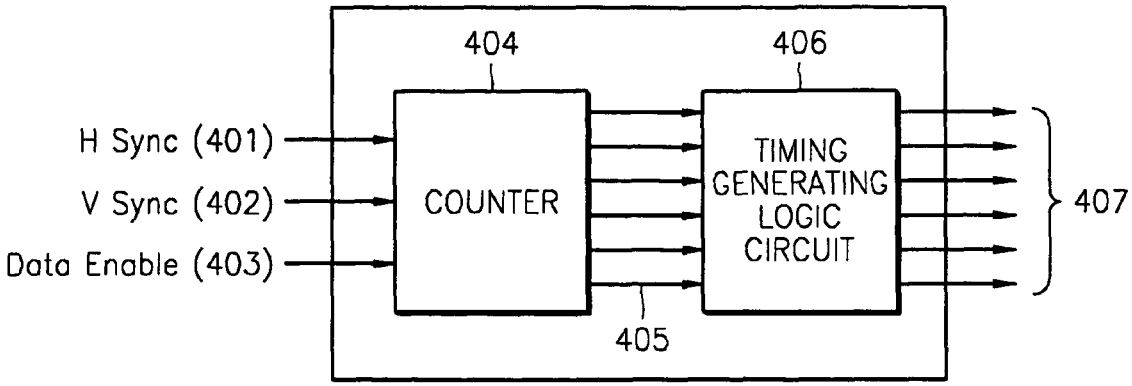
FIG. 4 (RELATED ART)
FIG. 4 is a view showing the configuration of a PDP XY controller according to the related art.
Figure 5:
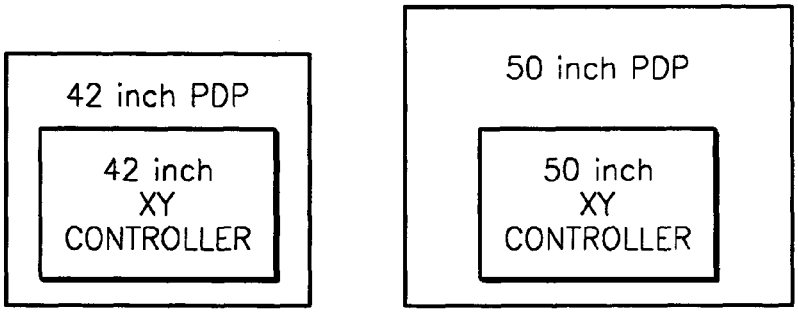
FIG. 5 (RELATED ART)
FIG. 5 is a view showing the configurations of PDP XY controllers of PDPS having different sizes, in accordance with the related art.
Figure 6:
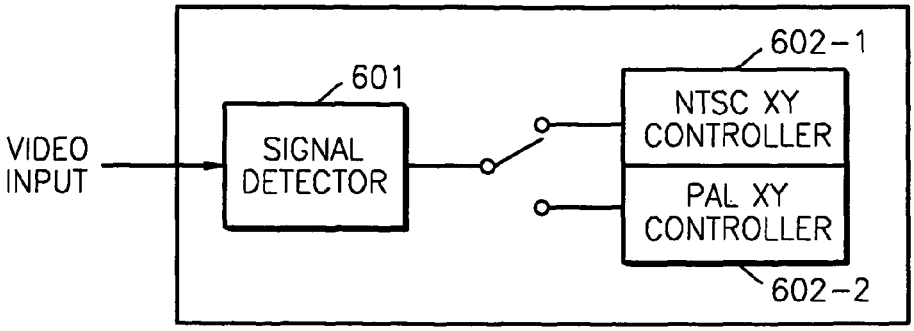
FIG. 6 (RELATED ART)
FIG. 6 is a view showing the configuration of a PDP XY controller according to the type of an input video signal, in accordance with the related art.

FIG. 3 shows the waveforms of X and Y electrode voltages in one sub field.

Hereinafter, exemplary embodiments of the present invention will be described in detail with reference to the attached drawings.

Figure 7:
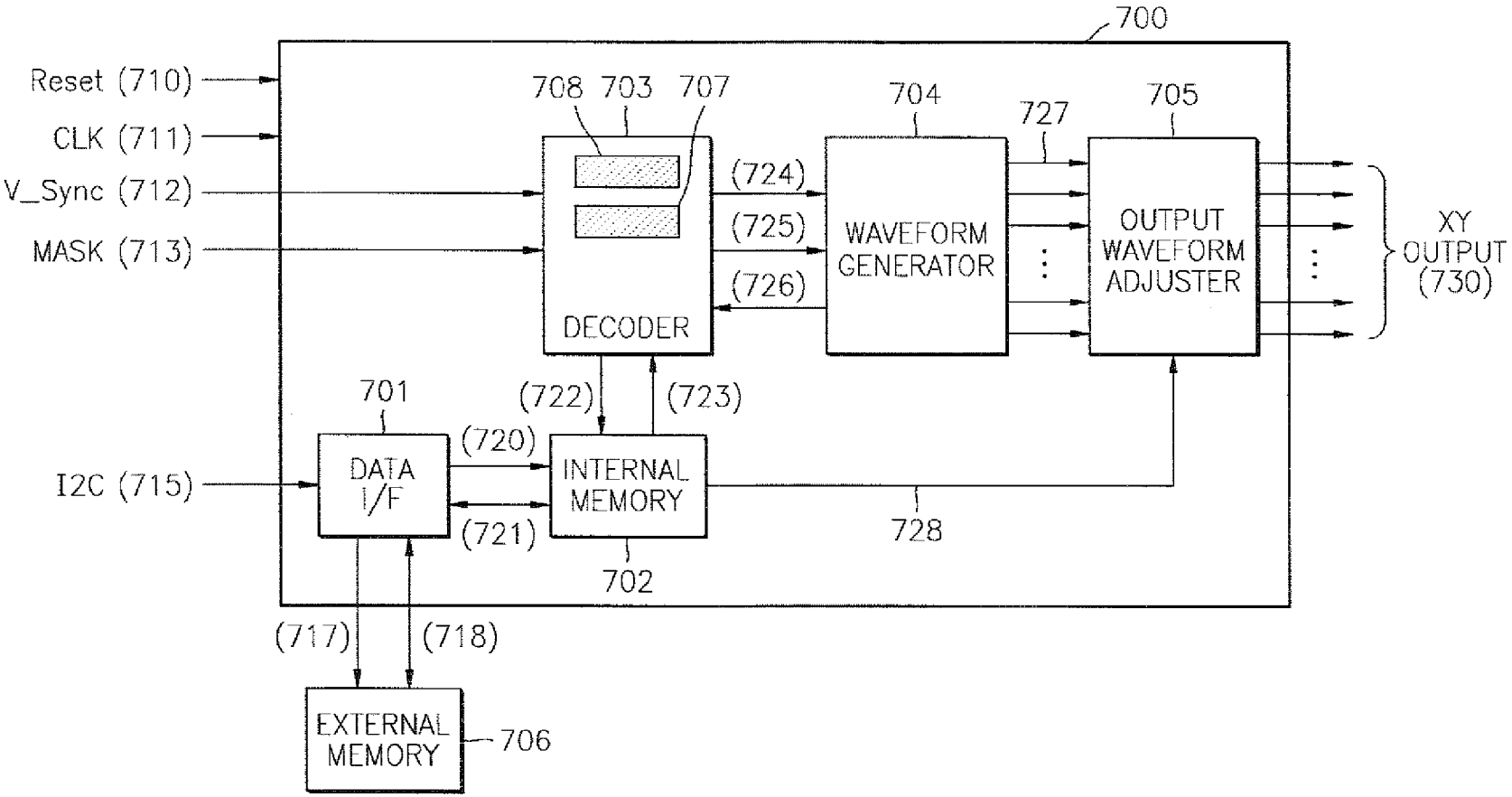
FIG. 7 is a view showing the configuration of an apparatus for generating a programmable signal to drive a PDP, according to the present invention.

FIG. 7 shows an apparatus for generating a programmable signal to drive a PDP, according to the present invention. Referring to FIG. 7, the apparatus includes a data interface circuit 701, an internal memory 702, a decoder 703, a waveform generator 704, an output waveform adjuster 705, and an external memory 706.

Here, the data interface circuit 701, the internal memory 702, the decoder 703, the waveform generator 704, and the output waveform adjuster 705 are combined into an XY electrode drive signal generating circuit 700.

The data interface circuit 701 has data communications with a computer and the like which communicate with a PDP driving apparatus and manages input and/or output of data to and/or from the internal and external memories 702 and 706. That is, the data interface circuit 701 writes data to and/or reads data from an assigned address via address lines 720 and 717 and data lines 721 and 718. To be more specific, the data interface circuit 701 writes data to and/or reads data from the internal memory 702 or the external memory 706 using a signal 715 received from an external device.

When power is applied to the XY electrode drive signal generating circuit 700, a reset signal 710 is released, and a reference clock signal 711 is input, the data interface circuit 701 reads data from the external memory 706 and then writes the read data to the internal memory 702.

When the decoder 703 receives vertical synchronous pulses V-Sync 712, the decoder 703 starts the following operations.

First, when the vertical synchronous pulses V-Sync 712 are input, a sub field counter 707 and a sequence counter 708 inside the decoder 703 are reset. The decoder 703 then reads a discharge number of a first sub field from a sustain table 804 (FIG. 8) stored in the internal memory 702 via a data line 723 using address information assigned to an address line 722. The sustain table 804 is divided into 255 sub sustain tables, one of which is appropriately selected according to the conditions such as average luminance of a screen and so forth.

The decoder 703 reads a sub field chain 802 from the internal memory 702. As shown in FIG. 9, the sub field chain 802 stores group numbers of sequence schedules of first through sixteenth sub fields. The number of sub fields is programmable and is not limited to 16, but may increase.

The decoder 703 reads information stored in a masking sub field table 808. As shown in FIG. 10, the masking sub field table 808 is designed so that a determination is made in each sub field as to whether masking is turned on or off. The masking sub field table 808 stores information to determine whether a function not to output a few signals is performed when a masking signal 713 is input according to the arbitrary conditions of an image.

Figure 8:
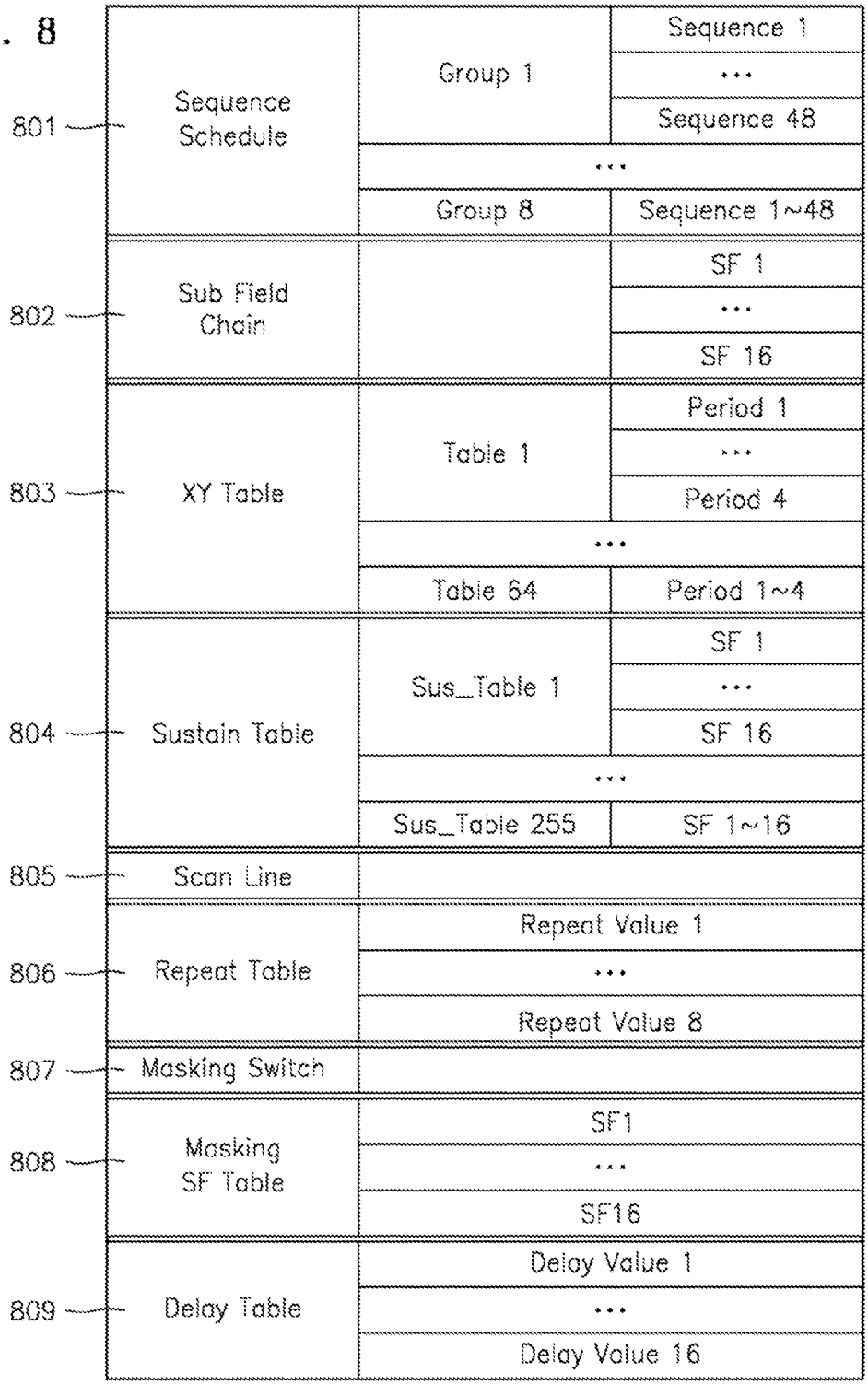
FIG. 8 is a view showing the data configuration of a memory adopted in he present invention.

The decoder 703 reads first sequence information of the same group number of a sequence schedule 801 as a group number stored in a first sub field of the sub field chain 802. As shown in FIG. 8, the sequence schedule 801 is divided into 8 groups, each of which includes 48 sequences. In the sequence schedule 801, the number of groups and the number of sequences may vary according to a design. In general, in the embodiment, 5 groups each having 30 sequences are sufficient to drive the PDP.

As shown in FIG. 11, one sequence information includes information 1101, 1102, 1103, and 1104. The information 1101 is to select an XY table number and hereinafter referred to as XY table number selection information. The information 1102 is to switch repeat start to repeat end and/or the repeat end to the repeat start and hereinafter referred to as repeat start and/or end switch information. The information 1103 is to select a repeat number and hereinafter referred to as repeat number selection information. The information 1104 is to switch the end of a sub field and hereinafter referred to as sub field end switch information.

The decoder 703 reads information stored in a corresponding XY table number, from an XY table 803 as shown in FIG. 12 with reference to the XY table number selection information 1101 of the first sequence number. The XY table 803 is divided into 64 XY tables, each of which is divided into four periods. Here, the number of tables may vary according to a design. FIG. 12 shows one XY table including four periods 1201, each of which stores delay table number selection information 1202, duration time information 1203, and XY pulse polarity information 1204.

The decoder 703 reads a delay value of a corresponding delay table with reference to the delay table number selection information 1202 in the periods 1201 of the XY table. As shown in FIG. 8, a delay table 809 stores 16 delay values. An example of the delay table 809 is shown in FIG. 13.

As described above, the decoder 703 reads XY table data from the internal memory 702 and then outputs an output timing synchronous signal 724 and XY table information 725 to the waveform generator 704 during reading of next XY table data. The XY table information 725 is a delay value which has been obtained with reference to the delay table number information 1202, the duration time information 1203, and the XY pulse polarity information 1204.

According to the examples of FIGS. 12 and 13, the XY table information 725 may be as shown in FIG. 14. That is, since selected delay table numbers of first and fourth periods are "0", the delay value is "0". When a selected delay table number of a second period is "2", the delay value is "5". When a selected delay table number of a third period is "3", the delay value is "10".

The waveform generator 704 generates XY drive pulse signals 727 using the XY table information 725 received from the decoder 703.

Figures 15, 16:
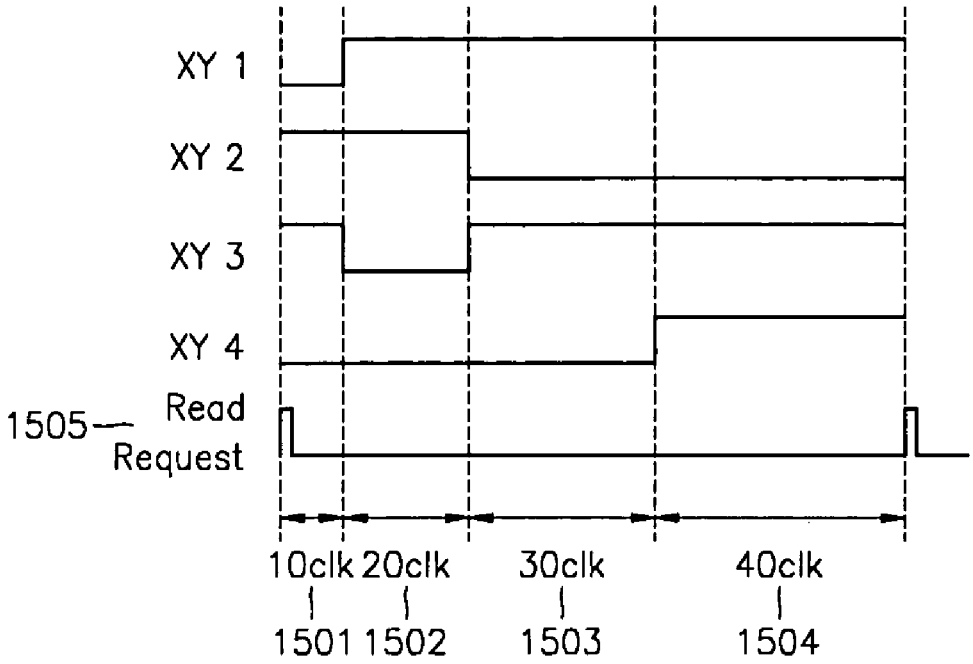
FIG. 15 is a view showing the waveforms of XY drive signals based on information of the XY table of FIG. 14.
FIG. 16 is a view showing the detailed configuration of a repeat table of FIG. 8.

The XY pulse signals 727 are generated by sustaining the polarities of XY pulses for duration times in the order of the first through fourth periods of the XY table information 725. For example, the waveforms of XY pulse signals generated from the XY table information of FIG. 14 are shown in FIG. 15. Although only the polarities of first through fourth XY pulse signals are shown in FIG. 15, it is obvious to those of ordinary skill in the art that the polarities of subsequent output XY pulse signals can be obtained using the same method.

Referring to FIGS. 14 and 15, polarity values of the first through fourth XY pulse signals are output as "0110" for 10 clocks within a first period 1501 of FIG. 15. Similarly, the polarity values of the first through fourth XY pulse signals are output as "1100" for 20 clocks with a second period 1502 of FIG. 15. The polarity values of the first through fourth XY pulse signals are output as "1010" for 30 clocks within a third period 1503 of FIG. 15. The polarity values of the first through fourth XY pulse signals are output as "1001" for 40 clocks within a fourth period 1504 of FIG. 15.

After the duration time of the fourth period has elapsed, the waveform generator 704 transmits a read request signal 1505 as shown in FIG. 15 to the decoder 703. In FIG. 7, the read request signal 1505 is denoted by reference numeral 726.

When the decoder 703 receives the read request signal 726 from the waveform generator 704, the decoder 703 performs a data read process as follows.

When the repeat start and/end switch information 1102 of a current sequence has a value of "0", the decoder 703 reads a next sequence. When the repeat start and/end switch information 1102 of the current sequence has a value of "1", this value indicates that the current sequence is a repeat start. In this case, the decoder 703 reads information of the current sequence a number of repeat times corresponding to the repeat number selection information 1103. When repeat numbers are 1-8, the decoder 703 reads repeat values corresponding to the repeat numbers 1-8 from a repeat table 806 stored in the internal memory 702. When the repeat number is 9, the decoder 703 reads a number of scan lines from a scan line register 805. When the repeat number is 10, the decoder 703 determines a sustain discharge number of a sustain table 804 as the number of repeat times.

When the repeat start and/or end switch information 1102 of the current sequence has a value of "2", this value indicates the current sequence is a repeat end. Thus, a number of repeat times of a group of sequences from the repeat start to the repeat end indicates the value "1" of the repeat start and/or end switch information 1102. The number of repeat times is compared with a number of repeat times of the group of sequences at the repeat start. If the number of repeat times is not greater than the number of repeat times at the repeat start, the decoder 703 returns to the sequence corresponding to the repeat start. If the number of repeat times is equal to the number of repeat times at the repeat start, the decoder 703 ends repeating reading of the current sequence and then reads information of a next sequence.

When the repeat start and/or end switch information 1102 of the current sequence has a value of "3", this value indicates that only the current sequence is repeated an assigned number of times. The number of repeat times of the current sequence is determined with reference to the repeat number selection information 1103.

The operation of the present invention will be described with reference to FIGS. 11 and 16.

A first sequence is executed one time. Since a second sequence includes the repeat start and/or end switch information 1102 with a value of "1", the second sequence indicates the repeat start and is executed three times corresponding to a repeat value of repeat number "1". A third sequence is executed. Since a fourth sequence includes the repeat end since the repeat start and/or end switch information 1102 with a value "2", the fourth sequence indicates the repeat end. Accordingly, the second through fourth sequences are repeated three times. Since a fifth sequence includes the repeat start and/or end switch information 1102 with a value "3", the fifth sequence is executed five times corresponding to a repeat value of repeat number "3". As a result, an order of executing sequences is "1→2→3→4→2→3→4→2→3→4→5→5→5→5→5→6→ . . . ".

The execution process of the sequences is performed until the sub field end switch information 1104 of the sequence schedule 801 becomes "1 (on)".

When the sub field end switch information 1104 has a value of "1", the sequence counter 708 of the decoder 703 is reset and "1" is added to the sub field counter 707 to be "2". Thus, a first sequence of a corresponding group number of the sequence schedule 801 is read with reference to a group number stored in a second sub field.

The above-described processes are repeated by the number of sub fields. When reading from all sub fields is ended, the decoder 703 is in a standby state until a next vertical synchronous pulse 712 is input.

The output waveform adjuster 705 receives the XY drive pulse signals 727, and masking switch information 807, masking sub field table information 808, and delay table information 809 from the internal memory 702 via a data line 728 to perform a delay process and a masking process.

The delay process will be first explained.

As can be seen in FIG. 14, delay values of the first through fourth periods are "0, 5, 10, and 0", respectively. In a case where the polarities of the XY drive pulses are changed in each of the first through fourth periods, i.e., from "0" to "1" or from "1" to "0", a point in time for the change is delayed by a number of clocks of the delay values. Thus, the XY drive pulse signals of FIG. 15 may be changed into XY drive pulse signals of FIG. 17. That is, since the polarities of the first and third XY drive pulse signals are changed within the first period, the first and second XY drive pulse signals are delayed by 5 clocks as denoted by reference numeral 1701. Since the polarities of the second and third XY drive pulse signals are changed within the second period, the second and third XY drive pulse signals are delayed by 10 clocks as denoted by reference numeral 1702. Pulse with unchanged polarities or pulses with polarities changed only at a delay value of "0" are not delayed.

Next, the masking process will be described.

Figures 17, 18:
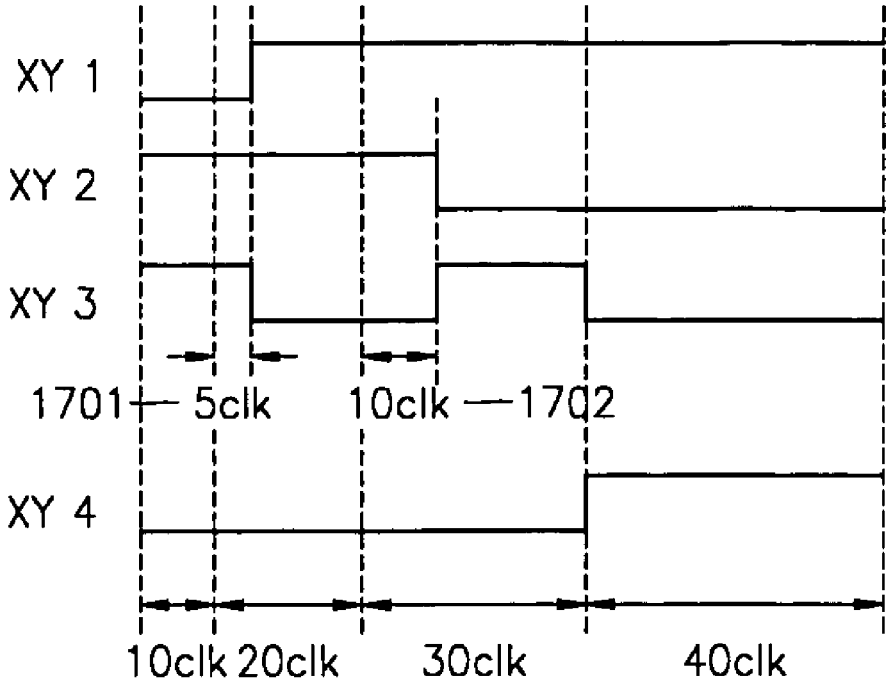
FIG. 17 is a view showing the delay states of the waveforms of XY drive signals based on information of the delay table of FIG. 8.
FIG. 18 is a view showing the detailed configuration of masking switch information of FIG. 8.

Masking conditions are determined based on the masking switch information 807 and the masking sub field table 808. The internal structure of the masking switch information 807 is shown in FIG. 18. The masking switch information 807 may be set with respect to all of XY drive pulse signals and specific output signals. In FIG. 18, the masking switch information 807 is set so that masking is on with respect to first and third XY drive pulse signals.

Figure 19A:
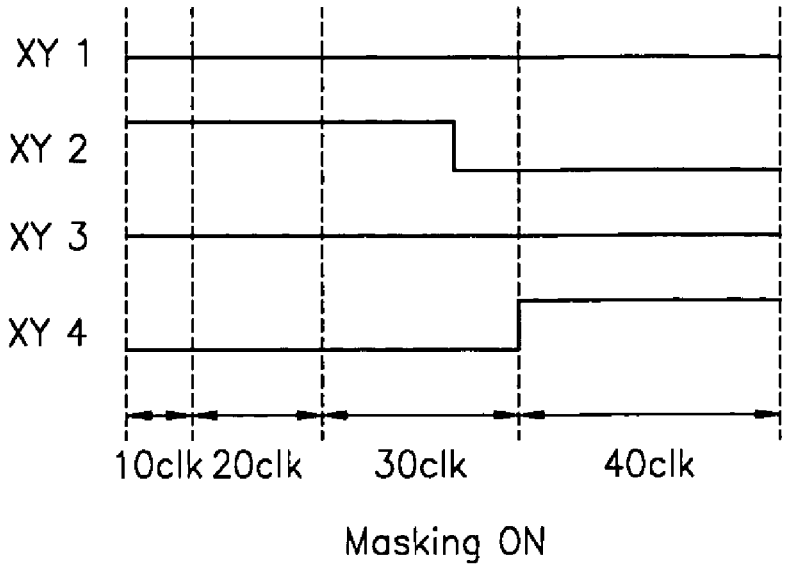
FIGS. 19A and 19B are views showing the waveforms of output XY drive signals depending on whether masking is turned on or off.
Figure 19B:
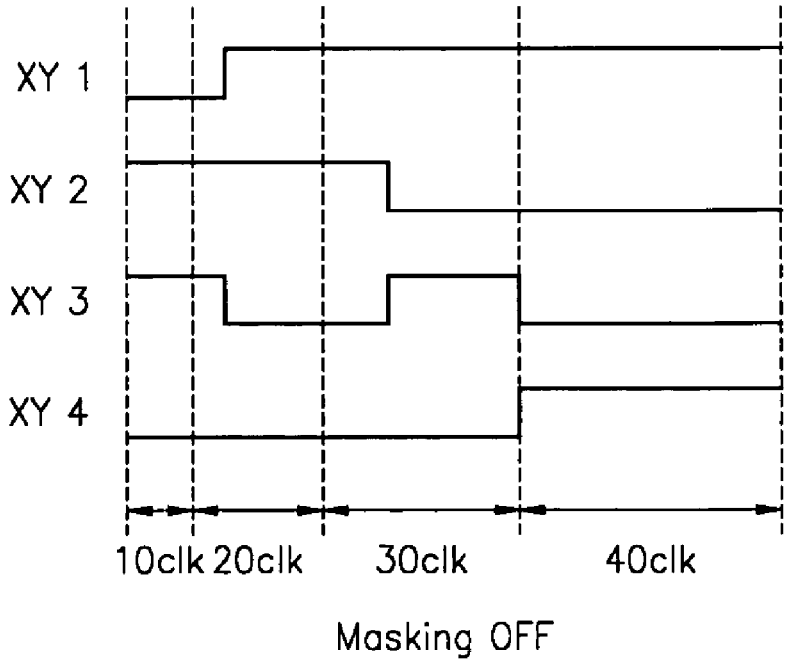

Masking of the waveforms of XY drive pulse signals is effective in sub fields in which masking switch information 807 is on. Thus, when the masking sub field table of FIG. 10 is used, the waveforms of the XY drive pulse signals are masked on in first through fourth sub fields and thirteenth through sixteenth sub fields and thus become as shown in FIG. 19A. Also, the waveforms of the XY drive pulse signals are masked off in fifth through twelfth sub fields and thus become as shown in FIG. 19B.

As described above, the output waveform adjuster 705 receives, delays, and masks the XY drive pulse signals 727 to output final XY drive pulse signals 730.

Figures 20, 21:
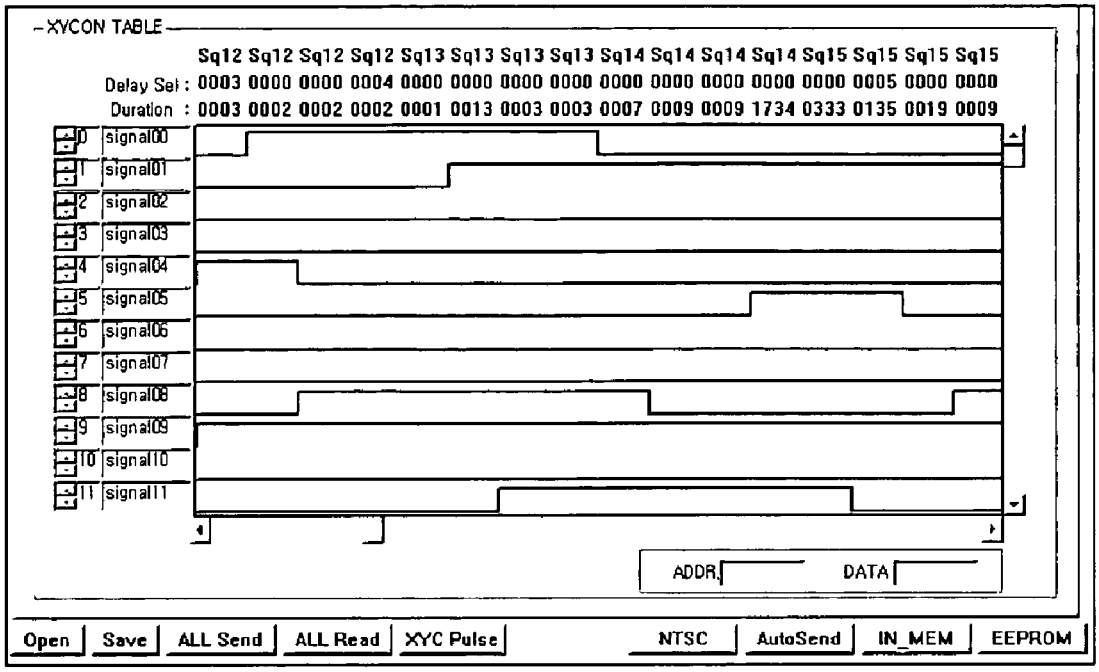
FIG. 20 is a view showing an example of a picture made by software which edits XY drive signals via a computer, according to the present invention.
FIG. 21 is a view showing the configuration of a memory to be applied to a plurality of types of video signals.

FIG. 20 shows a picture made by software to control the programmable XY drive signal generating apparatus of the present invention via a computer. As shown in FIG. 20, polarities of XY drive pulse signals, duration times, and other types of data can be visibly displayed via a graphic interface and thus easily edited.

FIG. 21 shows the configuration of the external memory 706 when the programmable XY drive signal generating apparatus of the present invention is suitable for a plurality of types of input signals. The external memory 706 includes an NTSC data area 2101, a PAL data area 2102, and a high definition (HD) data area 2103. Accordingly, only addresses are changed when data is input to and/or output from a memory according to types of input signals. Thus, data suitable for each type of video signal can be obtained. As a result, drive pulse signals suitable for a plurality of video signals can be generated without adding hardware components.

According to an aspect of the present invention, the internal memory 702 and the non-volatile, external memory 706 are used. However, since a speed for inputting data to and/or outputting data from the non-volatile memory 706 is generally slow, the internal memory 702 is additionally used in order to increase the speed. Therefore, when data is input to and/or output from a non-volatile external memory fast enough to meet a drive timing, an internal memory does not need to be used.

As described above, according to the present invention, data necessary for generating a signal to drive a PDP can be stored in respective areas of a memory according to the specifications of the PDP. Data suitable for the specifications of a used PDP product can be read from the memory to generate drive pulse signals. Thus, data stored in the memory can be edited to generate a drive signal without re-designing an XY controller whenever the specifications of the PDP and types of video signals are changed. The time required for designing the XY controller can be reduced and the size of the XY controller can be reduced. In particular, when the XY controller is designed to be suitable for a plurality of types of video signals, the size of the XY controller can be considerably reduced compared to the related art. Also, data necessary for drive pulse signals can be easily visibly edited using a computer.

The present invention can be realized as a method, an apparatus, a system, and the like. When the present invention is realized as software, components of the present invention are segments of a code for the execution of indispensable operations. A program or code segments can be stored in a processor-readable medium or can be transmitted by a computer data signal combined with a carrier in a transmission medium or over a communication network. The processor-readable medium can be any medium capable of storing or transmitting information. Examples of the processor-readable medium include an electronic circuit, a semiconductor memory device, a ROM, a flash memory, E2PROM, a floppy disc, an optical disc, a hard disc, an optical fiber, a radio frequency network, and so on. The computer data signal can include any signal which can be propagated over a transmission medium such as an electronic network channel, an optical fiber, air, an electromagnetic field, an RF network, and so forth.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for generating a programmable signal to drive a display panel, the apparatus comprising:

a memory that stores information to generate a plurality of drive pulse signals necessary for driving the display panel;

a decoder that reads information stored in an address assigned according to a predetermined control sequence from the memory, the read information being suitable for specifications of the display panel; and an output waveform generating circuit that generates drive pulse signals corresponding to the information read by the decoder, wherein the memory stores sequence schedule to assign group information comprising XY table number selection information, repeat start/end switch information, repeat number selection information, and sub field end switch information.

2. The apparatus of claim 1, wherein the memory stores the information to generate the plurality of drive pulse signals in its correlative areas.

3. The apparatus of claim 1, wherein the output waveform generating circuit comprises:

a waveform generator that transforms the information read by the decoder into drive pulse signals suitable for drive timings; and an output waveform adjuster that delays or masks and outputs the drive pulse signals generated by the waveform generator based on delay information and masking information read from the memory.

4. The apparatus of claim 1, further comprising a data interface circuit that manages input and/or output of data to and/or from the memory via data communications with an outer device.

5. The apparatus of claim 1 wherein, said memory contains information to generate a plurality of drive pulse signals necessary for driving the display panel for more than one type of input video signal.

6. An apparatus for generating a programmable signal to drive a display panel, the apparatus comprising:

a memory that stores information to generate a plurality of drive pulse signals necessary for driving the display panel;

a decoder that reads information stored in an address assigned according to a predetermined control sequence from the memory and then edits the read information so as to be suitable for specifications of the display panel; and an output waveform generating circuit that generates drive pulse signals corresponding to the information read by the decoder, wherein the memory stores sequence schedule to assign group information comprising XY table number selection information, repeat start/end switch information, repeat number selection information, and sub field end switch information, a sub field chain to assign each group an execution turn, an XY table to store polarities of a plurality of drive pulse signals within each drive period and for each duration time, and a repeat table to store data on a plurality of repeat values.

7. The apparatus of claim 6, wherein the memory further stores a delay table and a masking sub field table.

8. An apparatus for generating a programmable signal to drive a display panel, the apparatus comprising:

a memory that stores information to generate a plurality of drive pulse signals necessary for driving the display panel;

a decoder that reads information stored in an address assigned according to a predetermined control sequence from the memory and then edits the read information so as to be suitable for specifications of the display panel; and an output waveform generating circuit that generates drive pulse signals corresponding to the information read by the decoder, wherein the memory is divided into a sequence schedule area to store XY table number selection information, repeat number selection information, and sub field end switch information, a sub field chain area to store group numbers of a sequence schedule in each sub field, an XY table area to store polarities, duration times, and delay table numbers of XY drive pulse signals, a sustain table area to store a discharge number in each sub field, a scan line area to store a number of scan lines, a repeat table area to store a number of repeat times of sequences stored in the sequence schedule area, a masking switch area to store masking switch information of output signals, a masking sub field table area to assign each sub field whether masking is performed, and a delay table area to store delay values for adjusting delay times.

9. A method for generating a programmable drive signal to drive a display panel, the method comprising:

storing information to generate a plurality of drive pulse signals necessary for driving the display panel;

reading information stored in an address assigned according to a predetermined control sequence from a memory, the read information being suitable for specifications of the display panel; and generating drive pulse signals corresponding to the information read by a decoder, wherein the memory stores sequence schedule to assign group information comprising XY table number selection information, repeat start/end switch information, repeat number selection information, and sub field end switch information.

10. The method of claim 9, wherein the memory stores the information to generate the plurality of drive pulse signals in its correlative areas.

11. The method of claim 9 wherein, said memory contains information to generate a plurality of drive pulse signals necessary for driving the display panel for more than one type of said input video signal.

12. The method of claim 9, further comprising:

determining whether an input video signal or a specification of the display panel or both have changed; and editing information stored in the memory based on said determination.

13. The method of claim 9, further comprising:

transforming the information read by the decoder into drive pulse signals suitable for drive timings; and delaying or masking and outputting the drive pulse signals generated by based on delay information and masking information read from the memory.

14. A method for generating a programmable drive signal to drive a display panel, the method comprising:

storing information to generate a plurality of drive pulse signals necessary for driving the display panel;

reading information stored in an address assigned according to a predetermined control sequence from a memory and then editing the read information so as to be suitable for specifications of the display panel; and generating drive pulse signals corresponding to the information read by a decoder, wherein the memory stores sequence schedule to assign group information comprising XY table number selection information, repeat start/end switch information, repeat number selection information, and sub field end switch information, a sub field chain to assign each group an execution turn, an XY table to store polarities of a plurality of drive pulse signals within each drive period and for each duration time, and a repeat table to store data on a plurality of repeat values.

15. The method of claim 14, wherein the memory further stores a delay table and a masking sub field table.

16. A method for generating a programmable drive signal to drive a display panel, the method comprising:

storing information to generate a plurality of drive pulse signals necessary for driving the display panel;

reading information stored in an address assigned according to a predetermined control sequence from a memory and then editing the read information so as to be suitable for specifications of the display panel; and generating drive pulse signals corresponding to the information read by a decoder, wherein the memory is divided into a sequence schedule area to store XY table number selection information, repeat number selection information, and sub field end switch information, a sub field chain area to store group numbers of a sequence schedule in each sub field, an XY table area to store polarities, duration times, and delay table numbers of XY drive pulse signals, a sustain table area to store a discharge number in each sub field, a scan line area to store a number of scan lines, a repeat table area to store a number of repeat times of sequences stored in the sequence schedule area, a masking switch area to store masking switch information of output signals, a masking sub field table area to assign each sub field whether masking is performed, and a delay table area to store delay values for adjusting delay times.

17. A non-transitory computer-readable storage medium storing a program to cause a computer to implement a method of generating a programmable drive signal to drive a display panel, said method comprising:

storing information in a memory to generate a plurality of drive pulse signals necessary for driving the display panel;

reading information stored in an address assigned according to a predetermined control sequence from the memory, the read information being suitable for specifications of the display panel; and generating drive pulse signals corresponding to the information read by a decoder, wherein the memory stores sequence schedule to assign group information comprising XY table number selection information, repeat start/end switch information, repeat number selection information, and sub field end switch information.

* * * * *